US006620036B2

(12) United States Patent
Freeman et al.

(10) Patent No.: US 6,620,036 B2
(45) **Date of Patent: *Sep. 16, 2003**

(54) STACKED POLISHING PAD HAVING SEALED EDGE

(75) Inventors: Peter W. Freeman, Bear, DE (US); Marco A. Acevedo, Mesa, AZ (US); Jon D. Jacobs, Jr., Newark, DE (US)

(73) Assignee: Rodel Holdings, INC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/192,057

(22) Filed: Jul. 10, 2002

(65) Prior Publication Data

US 2002/0193059 A1 Dec. 19, 2002

Related U.S. Application Data

(62) Division of application No. 09/635,877, filed on Aug. 10, 2000.

(60) Provisional application No. 60/151,553, filed on Aug. 31, 1999, and provisional application No. 60/156,613, filed on Sep. 29, 1999.

(51) Int. Cl.[7] ..... B24D 11/00

(52) U.S. Cl. ..... 451/533; 451/538; 451/539; 451/59; 451/530; 451/537; 51/279; 51/295

(58) Field of Search ..... 451/533, 534, 451/538, 539, 59, 530, 537, 550; 51/279, 295

(56) References Cited

U.S. PATENT DOCUMENTS

| | | | | |
|---|---|---|---|---|
| 5,403,228 A | | 4/1995 | Pasch | 451/259 |
| 5,853,317 A | * | 12/1998 | Yamamoto | 451/288 |
| 5,893,796 A | | 4/1999 | Birang et al. | 451/526 |
| 6,439,968 B1 | * | 8/2002 | Obeng | 451/41 |

FOREIGN PATENT DOCUMENTS

| | | |
|---|---|---|
| DE | 198 07 948 A | 8/1999 |
| GB | 2 328 389 A | 2/1999 |
| JP | 11 151665 A | 6/1999 |
| WO | WO 97/02924 A | 1/1997 |

OTHER PUBLICATIONS

Patent Abstracts of Japan, vol. 1999, No. 11, Sep. 30, 1000.

* cited by examiner

*Primary Examiner*—Joseph J. Hail, III
*Assistant Examiner*—Alvin J. Grant
(74) *Attorney, Agent, or Firm*—Kenneth A. Benson; Edwin Oh; Blake T. Biederman

(57) ABSTRACT

A stacked polishing pad includes an upper polishing layer and a lower sub-layer having major faces which are in contact with each other. The polishing layer is substantially impermeable to liquid while the sub-layer is liquid absorbent. The sub-layer has an outer peripheral edge which is sealed to prevent absorption of liquid into the sub-layer through the outer peripheral edge. When the stacked polishing pad is mounted on a platen of a polishing machine, the sub-layer has no exposed surface which can absorb liquid.

12 Claims, 2 Drawing Sheets

STACKED POLISHING PAD HAVING SEALED EDGE

CROSS-REFERENCE TO RELATED APPLICATIONS

This application is a Division of application Ser. No. 09/635,877, filed Aug. 10, 2000, which claims the benefit of U.S. Provisional Application No. 60/151,553 filed Aug. 31, 1999, and which claims the benefit of U.S. Provisional Application No. 60/156,613 filed Sep. 29, 1999.

FIELD OF THE INVENTION

The invention relates to a polishing pad which is useful for planarizing a semiconductor wafer or other substrate, and in particular, to a polishing pad of the type having multiple stacked layers.

BACKGROUND OF THE INVENTION

"Microelectronic substrate" is intended to mean semiconductor devices or precursors thereto, including semiconductor wafers, semiconductor device layers comprising an insulator, semiconductor, barrier layer, conductor or any combination thereof.

Semiconductor wafers having integrated circuits fabricated thereon must be polished to provide a very smooth and flat wafer surface which in some cases may vary from a given plane by as little as a fraction of a micron. Such polishing is usually accomplished in a chemical-mechanical polishing (CMP) operation which utilizes a chemically active slurry that is buffed against the wafer surface by a polishing pad.

A polishing pad is often a relatively thin, disk-shaped article that is mounted on a platen of a polishing machine. Some polishing pads comprise two or more layers of different material that are coextensive and secured together by adhesive.

In the case of a two layer pad, the upper layer is a polishing layer that is relatively hard and stiff so that it maintains a planar polishing surface and provides a high rate of wafer material removal. The upper layer is substantially impermeable to the slurry and de-ionized water generally used in the polishing and washing operations.

The lower layer is typically a sub-pad that is softer than the upper layer to provide a cushion for the upper layer. The sub-pad tends to absorb the slurry and de-ionized water to which it is exposed. The sub-pad is shielded from these liquids by the coextensive upper layer and by the adhesive. However, the peripheral edge of the sub-pad is unshielded and is exposed to the liquid. As the liquid penetrates the sub-pad, physical properties of the sub-pad may change, thereby changing the cushioning effect of the sub-pad and the polishing performance of the stacked polishing pad.

Also, some polishing pads have a transparent window that permits the use of optical equipment for detecting a polishing endpoint. Liquid which penetrates into the sub-pad may reach the transparent window area and disturb the optical path through the window.

SUMMARY OF THE INVENTION

The present invention is directed to a stacked polishing pad comprising a polishing layer and a sub-layer. The polishing layer is substantially impermeable to water-based liquid (or is at least much less permeable than the sub-layer), while the sub-layer is liquid absorbent (or at least significantly more permeable to water-based liquids relative to the polishing layer). The polishing layer is preferably stacked on the sub-layer and is in contact therewith so as to shield an upper surface of the sub-layer from liquid contact. The sub-layer has an outer peripheral edge which is sealed to prevent liquid absorption into the sub-layer through the outer peripheral edge. When the stacked polishing pad is mounted on a platen of a polishing machine, the sub-layer has little, if any, exposed surface which can absorb liquid.

According to one embodiment of the invention, the stacked polishing pad may have an annular shape and include a central opening which is delineated by an inner peripheral edge. Preferably, the inner peripheral edge of the sub-layer is also sealed to prevent absorption of liquid into the sub-layer.

Peripheral edges of the sub-layer may be sealed by any suitable means including heat sealing, pressure embossing, and waterproof coating.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
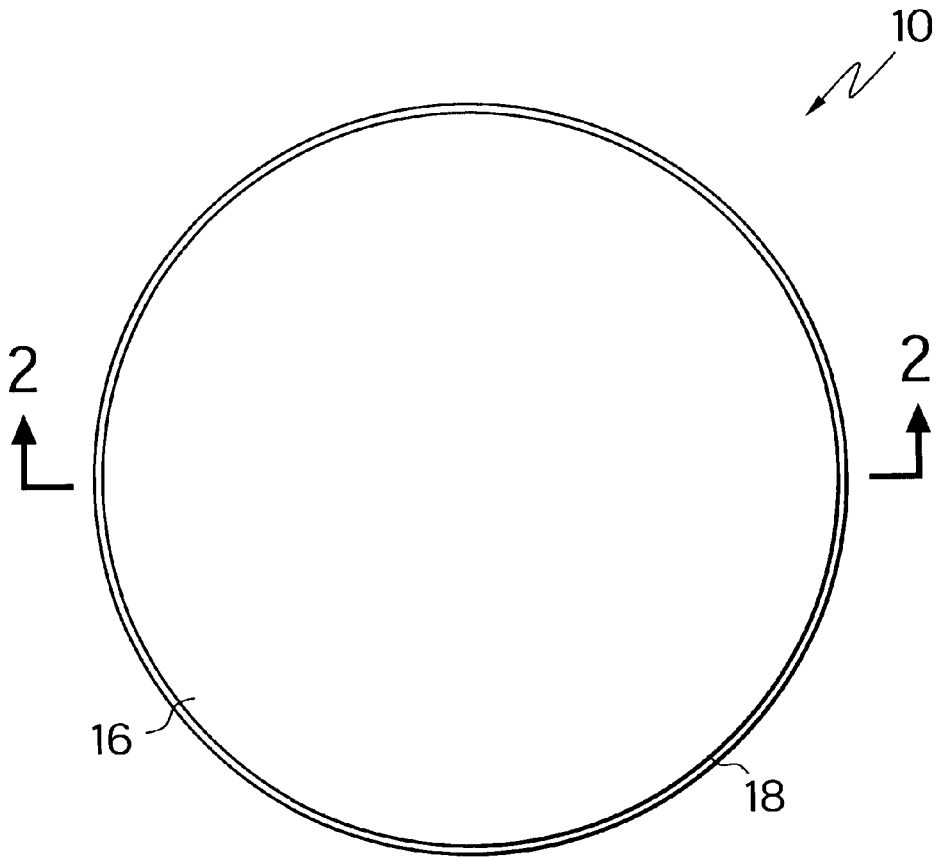
FIG. 1 is a top plan view of a stacked polishing pad according to the invention.
Figure 2:
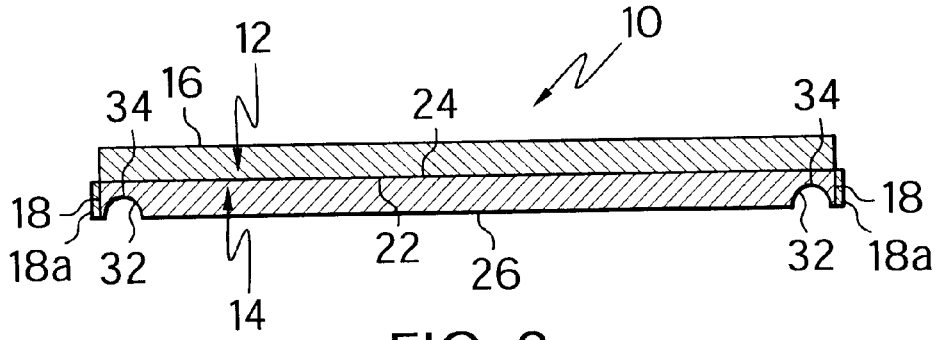
FIG. 2 is a cross-sectional view of the polishing pad taken along line 2—2 of FIG. 1.

As shown in FIGS. 1 and 2, a stacked polishing pad 10 according to the invention comprises an upper layer 12 and a lower layer 14. The upper layer 12 is a polishing layer having a polishing surface 16. The polishing layer is made from a material that is selected according to the substrate that is being polished to provide an effective combination of polishing characteristics. The polishing layer should be relatively hard and stiff to provide a high material removal rate and good surface planarity and uniformity. An example of an effective polishing layer material is that which is sold under the name IC 1000 by Rodel, Inc., of Newark, Del. U.S.A. This material is substantially impermeable to the de-ionized water and water based slurries that are used in the polishing and washing processes of a chemical-mechanical polishing operation.

The lower layer 14 is a sub-pad or sub-layer that is relatively softer than the polishing layer 12. The relatively softer sub-layer 14 provides a cushion that permits the polishing layer 12 to conform to macro-scale surface irregularities of an article that is being polished. An example of an effective sub-layer material is that which is sold under the name Suba IV by Rodel, Inc., of Newark, Del. U.S.A. This material is somewhat absorbent of de-ionized water and water based slurries.

The polishing layer 12 and the sub-layer 14 have respective major surfaces 22, 24 which are in contact at an interface and are secured together by an adhesive. The polishing layer 12 and the adhesive shield the top major surface 24 of the sub-layer 14 from contact with polishing liquids. Prior to polishing, bottom major surface 26 of the sub-layer is secured to a platen of a polishing machine (not shown) by an adhesive, thereby preventing liquid contact with the bottom major surface 26.

According to the invention, outer peripheral edge 18 of the sub-layer 14 is sealed to prevent liquid absorption into the sub-layer through the outer peripheral edge. A sealed edge may be provided by any suitable technique which is effective to create a barrier to liquid penetration. The edge may be sealed, for example, by heating or pressure embossing the edge to create a liquid barrier.

As shown in FIG. 2, a sealed edge may be provided by pressure-embossing the sub-layer 14 to form a groove or indentation 32 which extends circumferentially around the bottom major surface 26 adjacent to the outer peripheral edge 18. Material that is displaced from the indentation 32 is forced into a zone of compacted material 34. The compacted material 34 is substantially impermeable to liquid due to its relatively high density.

In a preferred embodiment, the indentation 32 has a U-shaped cross-section which is 0.035 inch deep and 0.063 inch wide in a sub-layer 14 that is 0.050 inch thick, and the indentation 32 is recessed 0.250 inch radially inward from the outer peripheral edge 18.

Alternatively, the indentation 32 may have a V-shape or any other suitable cross-sectional shape.

A sealed edge may also be provided by a waterproof coating such as silicon rubber that is applied over the peripheral edge 18.

Figure 3:
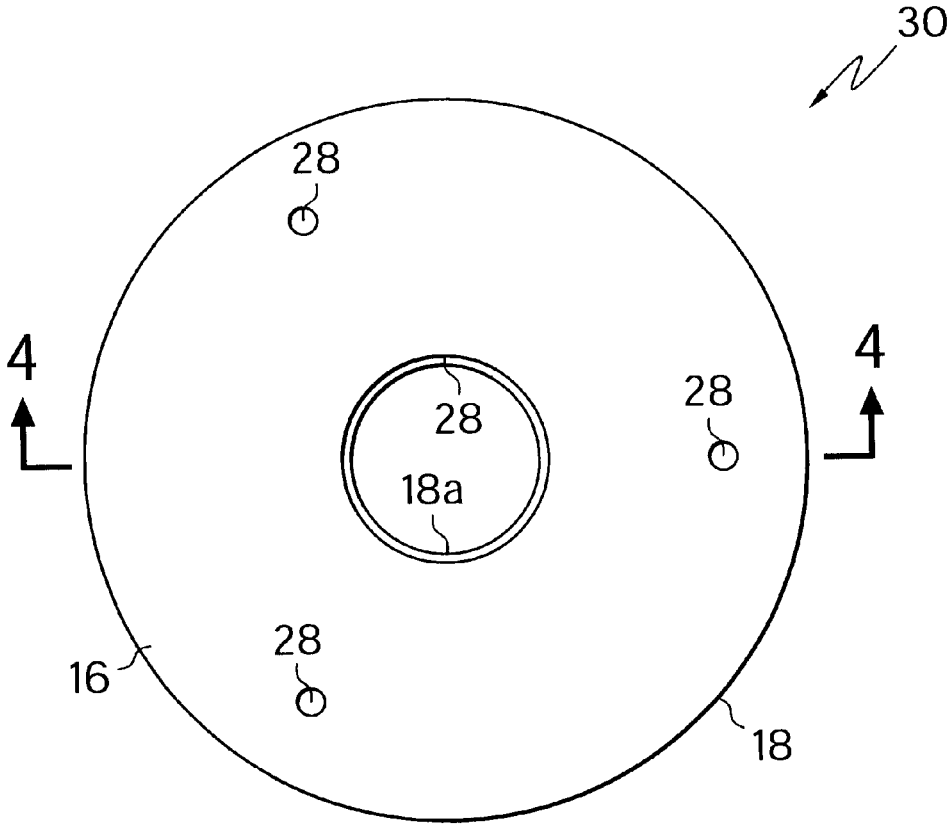
FIG. 3 is a top plan view of a stacked polishing pad in an alternate embodiment according to the invention.
Figure 4:
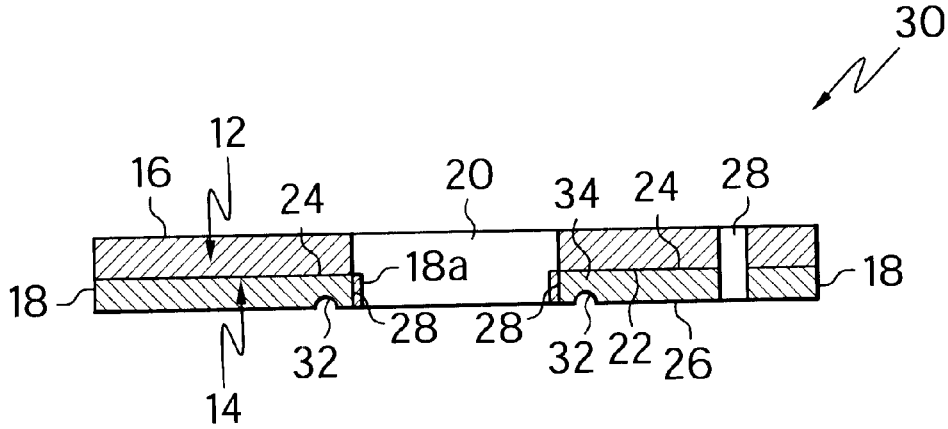
FIG. 4 is a cross-sectional view of the polishing pad taken along lines 4—4 of FIG. 3.

Another embodiment of the invention is shown in FIGS. 3 and 4 wherein elements which are the same as in FIGS. 1 and 2 are denoted by the same reference numerals as used therein. In this embodiment, a stacked polishing pad 30 has an annular shape and includes a central opening 20 which is delineated by an inner peripheral edge 28. In this case, the inner peripheral edge 28 of the sub-layer 14 may also be sealed by any suitable technique as discussed above with regard to the outer peripheral edge 18.

According to other embodiments of the invention, a stacked polishing pad may have one or more different cutouts or regions of various shape which are delineated by respective peripheral edges. Selected ones of the peripheral edges may be sealed in the sub-layer in order to customize the stacked pad properties in different regions of the polishing pad.

We claim:

1. A polishing pad comprising:

an upper layer formed from a first material impermeable to liquid;

a lower layer fixed to the upper layer, the lower layer formed from a second material capable of absorbing liquid and having a bottom surface and an outer peripheral edge; and a circumferential zone of compacted material impermeable to liquid formed in the bottom surface of the lower layer adjacent the outer peripheral edge.

2. The polishing pad of claim 1, wherein the circumferential zone of compacted material includes a pressure-embossed indentation.

3. The polishing pad of claim 2, wherein the indentation is a U-shaped groove.

4. The polishing pad of claim 2, wherein the indentation is a V-shaped groove.

5. An annular polishing pad comprising:

an upper layer formed from a material impermeable to liquid and having a first central opening;

an annular lower layer formed from a second material capable of absorbing liquid and having a bottom surface and a second central opening with an inner peripheral edge, the lower layer fixed to the upper layer such that the first and second central openings are aligned; and a circumferential zone of compacted material impermeable to liquid formed in the bottom surface of the lower layer adjacent the inner peripheral edge.

6. The polishing pad of claim 5, wherein the circumferential zone of compacted material includes a pressure-embossed indentation.

7. The polishing pad of claim 6, wherein the indentation is a U-shaped groove.

8. The polishing pad of claim 6, wherein the indentation is a V-shaped groove.

9. A polishing pad comprising:

an upper layer formed from a first material impermeable to liquid, the upper layer having a first outer peripheral edge;

a lower layer fixed to the upper layer, the lower layer formed from a second material capable of absorbing liquid and having a bottom surface and a second outer peripheral edge;

a circumferential zone of compacted material impermeable to liquid formed in the bottom surface of the lower layer adjacent the second outer peripheral edge; and a side layer fixed to the second outer peripheral edge, the side layer being impermeable to liquid.

10. The polishing pad of claim 9, wherein the circumferential zone of compacted material includes a pressure-embossed indentation.

11. The polishing pad of claim 10, wherein the indentation is a U-shaped groove.

12. The polishing pad of claim 10, wherein the indentation is a V-shaped groove.

* * * * *